US007694435B1

(12) United States Patent
Kiser et al.

(10) Patent No.: US 7,694,435 B1
(45) Date of Patent: Apr. 13, 2010

(54) FOLDABLE FLIP FLOP WITH FORMED HINGE

(76) Inventors: Mary Kiser, 1409 Havenhurst Dr., Los Angeles, CA (US) 90046; Allen D. Hertz, 12784 Tulipwood Cir., Boca Raton, FL (US) 33428

( * ) Notice: Subject to any disclaimer, the term of this patent is extended or adjusted under 35 U.S.C. 154(b) by 813 days.

(21) Appl. No.: 11/518,830

(22) Filed: Sep. 11, 2006

(51) Int. Cl.
*A43B 3/12* (2006.01)
*A43B 1/10* (2006.01)

(52) U.S. Cl. ..... 36/11.5

(58) Field of Classification Search ..... 36/11.5, 36/102, 25 R, 97
See application file for complete search history.

(56) References Cited

U.S. PATENT DOCUMENTS 2,924,029 A * 2/1960 Rosen ..... 36/7.1 R
4,507,879 A * 4/1985 Dassler ..... 36/102
4,967,491 A * 11/1990 Plotkin ..... 36/7.1 R
5,678,327 A * 10/1997 Halberstadt ..... 36/27
5,694,706 A * 12/1997 Penka ..... 36/103
6,115,945 A * 9/2000 Ellis, III ..... 36/102
6,189,239 B1 * 2/2001 Gasparovic et al. ..... 36/102
6,412,196 B1 * 7/2002 Gross ..... 36/102
6,836,976 B2 * 1/2005 Haugland ..... 36/10
6,990,755 B2 * 1/2006 Hatfield et al. ..... 36/97
7,032,327 B1 4/2006 Tartaglia et al.
7,284,341 B2 * 10/2007 Moseley ..... 36/11.5
7,430,817 B2 * 10/2008 Abadjian et al. ..... 36/29
7,437,838 B2 * 10/2008 Nau ..... 36/102
7,448,148 B2 * 11/2008 Martinez et al. ..... 36/11.5

* cited by examiner

*Primary Examiner*—Ted Kavanaugh
(74) *Attorney, Agent, or Firm*—Allen D. Hertz

(57) ABSTRACT

A foldable flip flop which incorporates a flexible hinge within a sole of the footwear. The flexible hinge consists of a molded flexible hinge section 40, a molded hinge aperture 38, a hinge top recess 34 and a hinge limitation contact section 42. The molded flexible hinge section 40 and molded hinge aperture 38 provides a flexible and reliable member allowing the sole to be folded. The sole can comprise a hinge section along a transverse orientation or a longitudinal orientation about the center of the sole. The hinge limitation contact section 42 ensures that a heel section of the sole remains in a wearable configuration during use.

14 Claims, 4 Drawing Sheets

FOLDABLE FLIP FLOP WITH FORMED HINGE

FIELD OF THE INVENTION

The present invention relates generally to a footwear commonly referred to as a flip flop, more specifically, one that incorporates a formed hinge allowing the flip flop to be folded for storage.

BACKGROUND OF THE INVENTION

People wear footwear to protect their feet from hazards, heat, and other items when walking. Flip Flops are one form of footwear, generally a style of footwear that is associated with a more causal environment. Further, that style of footwear is conducive to being a carry along type of item for such scenarios as a trip to the beach, where the flip flops would only be worn at the destination and packed during travel.

Tartaglia, et al. teaches, in U.S. Pat. No. 7,032,327, a footwear that is collapsible. Tartaglia, et al. teaches a footwear comprising an intermediate portion includes sufficient flexibility to significantly reduce the size of the sandal by folding the sole into a stored orientation defined by the front and rear portions disposed in at least partially overlying relation to one another. The design of the intermediate portion of Tartaglia, et al. is limited in that the fold section is not a favorable and reliable hinge design. Further, as said intermediate section continues to flex, not only will the flexible section allow the sole to collapse as designed, but it will also allow the heel section of the sole to hang downward when walking causing potential injury to the wearer and excessive wear to the heel section of the footwear.

What is desired is inexpensive footwear that is foldable for storage. Further desired is a foldable mechanism that is reliable and ensures the heel section of the footwear remains in a planar configuration when worn.

SUMMARY OF THE INVENTION

Accordingly, the present invention provides an apparatus for wearing on a person's feet, more specifically a foldable footwear. The footwear incorporates a hinge for folding said footwear into a more compact shape for storage.

A first aspect of the present invention is a flip flop style of footwear.

A second aspect of the present invention is a flip flop style of footwear with a foldable section.

A third aspect of the present invention is a flip flop style of footwear with a foldable section, wherein said foldable section provides a hinge that is transverse to the flip flop.

A fourth aspect of the present invention is a flip flop style of footwear with a foldable section, wherein said foldable section provides a hinge that is longitudinally to the flip flop.

A fifth aspect of the present invention is a flip flop style of footwear with two foldable sections, wherein said foldable sections provides a first hinge that is transverse to the flip flop and a second hinge that is longitudinally to the flip flop.

A sixth aspect of the present invention is a hinge design wherein said hinge is molded into a sole of the flip flop.

A seventh aspect of the present invention is a hinge design wherein said hinge is molded into the sole of the flip flop, wherein said hinge comprising an aperture or slot along the length of the hinge.

An eighth aspect of the present invention is a hinge design wherein said hinge is molded into the sole of the flip flop, wherein said hinge comprising a limit feature to ensure that the sole of the flip flop remains planar in a worn configuration.

A ninth aspect of the present invention is a hinge design wherein said hinge is molded into the sole of the flip flop, wherein said hinge comprising a limit feature to ensure that the sole of the flip flop remains planar in a worn configuration, wherein said limit feature further comprising a contact point.

A tenth aspect of the present invention is wherein said hinge is of a symmetric design.

An eleventh aspect of the present invention is a hinge upper clearance section.

A twelfth aspect of the present invention is an upper shoe section for removably coupling said flip flop to a wearer's foot.

A thirteenth aspect of the present invention is wherein said hinge sections are oriented approximately at the center of the footwear.

A fourteenth aspect of the present invention is wherein said hinge sections are oriented approximately at the center of the footwear and in a transverse orientation.

A fifteenth aspect of the present invention is wherein said hinge sections are oriented approximately at the center of the footwear and in a longitudinal orientation.

A sixteenth aspect of the present invention is the inclusion of a storage bag for said footwear.

A seventeenth aspect of the present invention is the inclusion of a storage bag for said footwear, wherein said bag is sized to store said footwear in a folded configuration.

The disclosed aspects of the present invention define each aspect individually, wherein it is understood that each of the aspects can be combined to provide various embodiments of a foldable flip flop.

BRIEF DESCRIPTION OF THE DRAWINGS

The present invention, together with further objects and advantages thereof may best be understood by reference to the following description taken in conjunction with the accompanying drawings in which.

Various like features are shown throughout the drawings. It is recognized that the features described for a transverse hinge can be applied to a longitudinal hinge.

DETAILED DESCRIPTION OF THE INVENTION

Figure 1A:
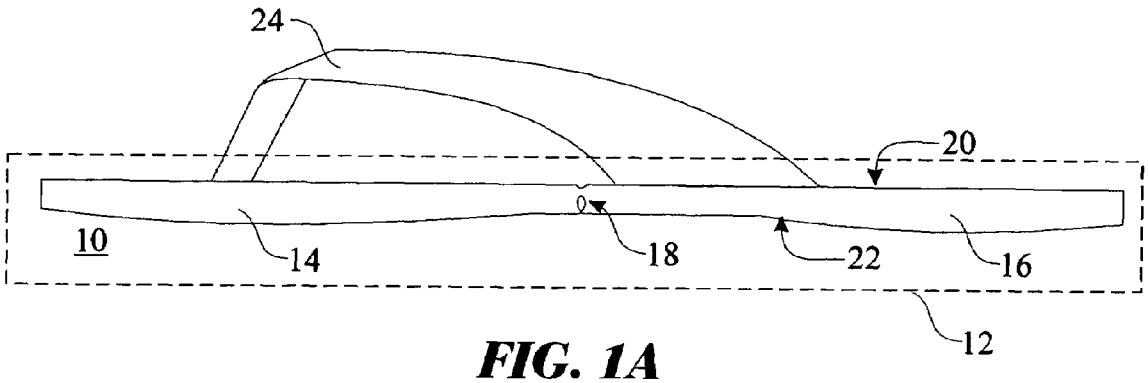
FIG. 1 presents a side view, top view and bottom view of a flip flop incorporating the present invention.
Figure 1B:
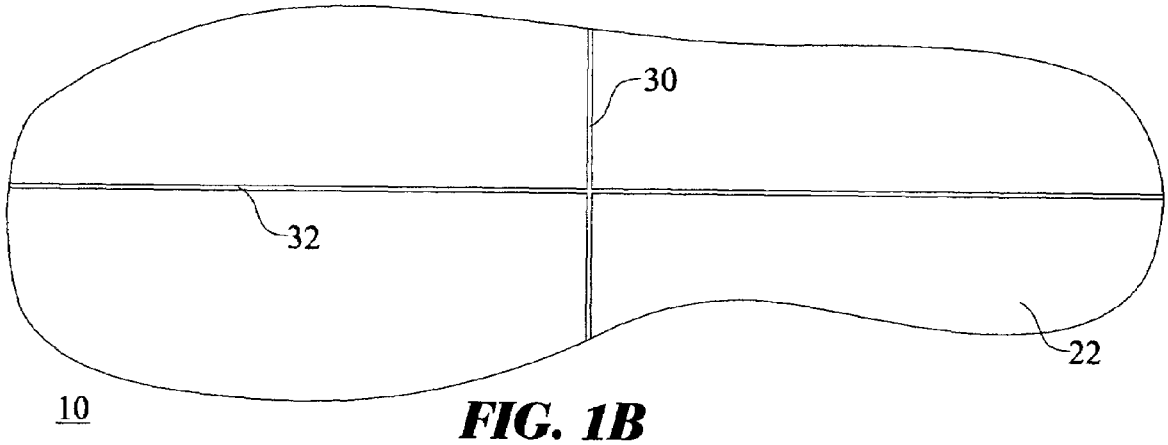
Figure 1C:
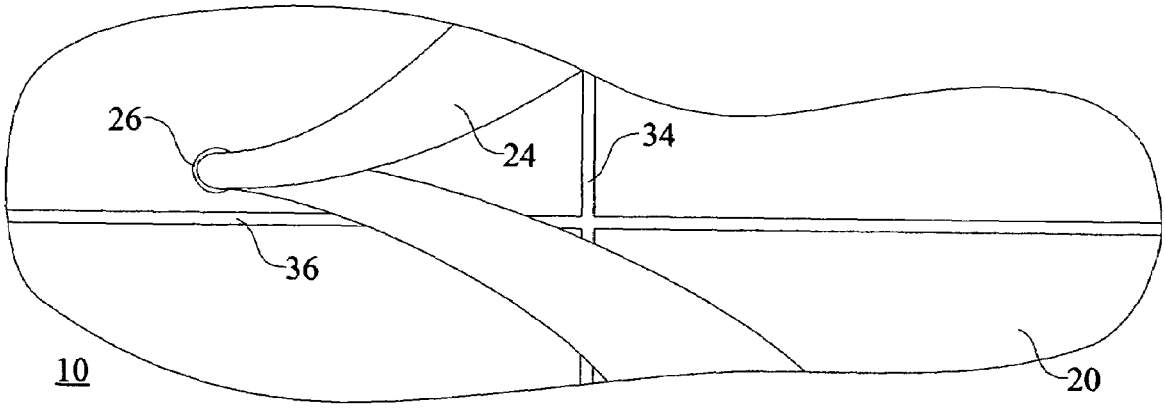

FIG. 1 presents various orientations of a foldable flip flop 10, including a side view as illustrated in FIG. 1A, a bottom view as illustrated in FIG. 1B and a top view as illustrated in FIG. 1C. Said foldable flip flop 10 comprising a flip flop sole with molded hinge 12 and a flip flop upper strap member 24. Said flip flop sole with molded hinge 12 is a single, molded sole that is generally fabricated of molded rubber. Said flip flop upper strap member 24 is assembled to said flip flop sole with molded hinge 12 to provide an upper member for coupling said foldable flip flop 10 to a wearer's foot (not shown). Said flip flop upper strap member 24 couples to said foldable flip flop 10 at a midpoint via a upper front securing aperture 26. Said flip flop upper strap member 24 can be of a woven canvas, molded plastic, molded rubber, leather, and the like. It is recognized that jewels and other decorative items can be added to said flip flop upper strap member 24. Various features of said foldable flip flop 10 comprise a sole toe section 14 and a sole heel section 16. Additionally introduced are a foot contact surface 20 and a ground contact surface 22. Said foldable flip flop 10 incorporates a molded hinge section 18. Several features respective to said molded hinge section 18 located on the ground contact surface 22 of said foldable flip flop 10 include a transverse hinge stop contact section 30 and a longitudinal hinge stop contact point 32. Further, features respective to said molded hinge section 18 located on the foot contact surface 20 of said foldable flip flop 10 include a transverse hinge top recess 34 and a longitudinal hinge top recess 36.

Figure 2A:
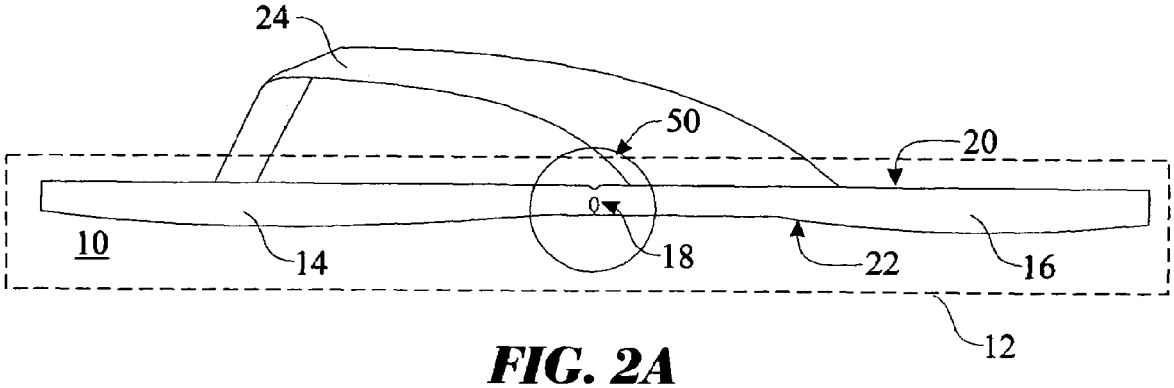
FIG. 2 presents a side view of a flip flop incorporating the present invention, further detailing a moldable hinge section.
Figure 2B:
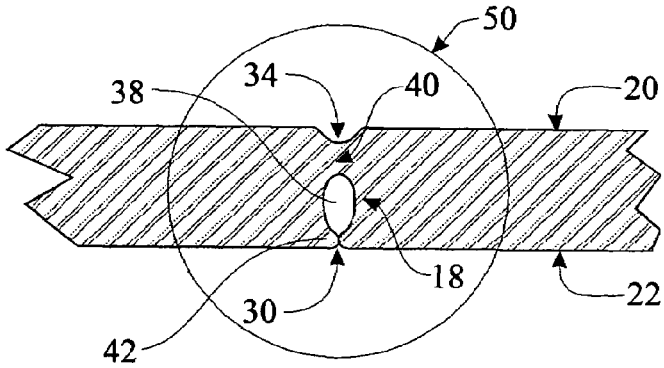
Figure 2C:
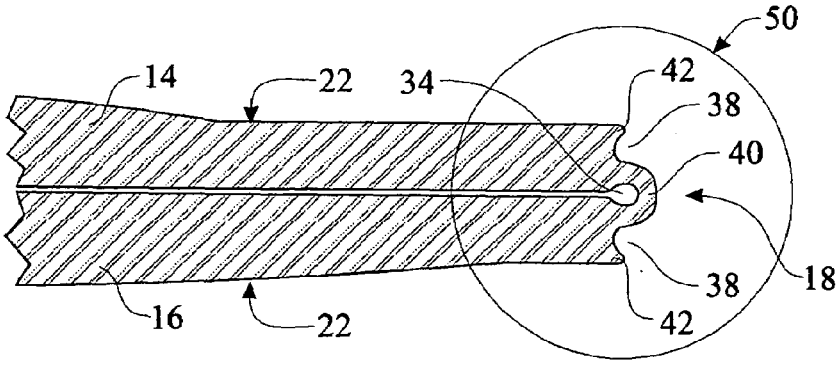

FIG. 2 presents a more detailed illustration of said molded hinge section 18 shown in both a wearable state as illustrated in FIG. 2B and a stored state as illustrated in FIG. 2C. FIG. 2A illustrates said foldable flip flop 10 of FIG. 1, further presenting said enlarged detailed hinge section 50, wherein said enlarged detailed hinge section 50 is to illustrate said molded hinge section 18 in more detail. FIG. 2B illustrates said molded hinge section 18 in a wearable configuration, wherein said molded hinge section 18 comprising said transverse hinge stop contact section 30 and said transverse hinge top recess 34 as introduced in FIG. 1. Said molded hinge section 18 incorporates a flexible hinge aperture 38 and a molded flexible hinge section 40 which combined provide a flexible cross section of said molded hinge section 18. Said transverse hinge top recess 34 is a recess incorporated to reduce any bulging or creasing of the material of said flip flop sole with molded hinge 12, wherein when said flip flop sole with molded hinge 12 is folded as shown in FIG. 2C. Without said transverse hinge top recess 34, the material of said flip flop sole with molded hinge 12 would bulge or crease along said foot contact surface 20. Said flexible hinge aperture 38 provides a reduced cross sectional area about said molded hinge section 18, thus creating a more flexible section about said molded flexible hinge section 40. To ensure that said sole heel section 16 does not droop when a wearer is wearing and walking in said foldable flip flop 10, the present invention incorporates an inventive footwear hinge limitation contact section 42. Said hinge limitation contact section 42 is presented as a ridge that runs generally parallel to said molded hinge section 18. It is preferred that said hinge limitation contact section 42 is incorporated into said molded hinge section 18 as a pair, one said hinge limitation contact section 42 associated on a sole toe section 14 side and an opposing said hinge limitation contact section 42 associated on a sole heel section 16 side wherein said hinge limitation contact section 42 contact along said transverse hinge stop contact section 30. Said hinge limitation contact section 42 provides a feature of said molded hinge section 18 that maintains said flip flop sole with molded hinge 12 in a normal state when worn, ensuring that said sole heel section 16 section does not flex downward towards the ground when said foldable flip flop 10 is worn. It is recognized that other form factors can be incorporated to provide the same features as said hinge limitation contact section 42 as illustrated. FIG. 2C illustrates said foldable flip flop 10 in a stored orientation. When storing said foldable flip flop 10, the user would fold said foldable flip flop 10 as illustrated contacting along said foot contact surface 20 and having said ground contact surface 22 on the outer or exposed side of the fold. The illustration presents the benefit of said transverse hinge top recess 34 as well as the flexibility of said molded flexible hinge section 40 resulting from the area reduced by the incorporation of said flexible hinge aperture 38.

It is recognized that the features are illustrated respective to a hinge that is oriented transverse to said flip flop sole with molded hinge 12, the same features are incorporated in a hinge that is oriented longitudinal to said flip flop sole with molded hinge 12, such as along said longitudinal hinge stop contact point 32 and said longitudinal hinge top recess 36 presented in FIG. 1.

Figure 3:
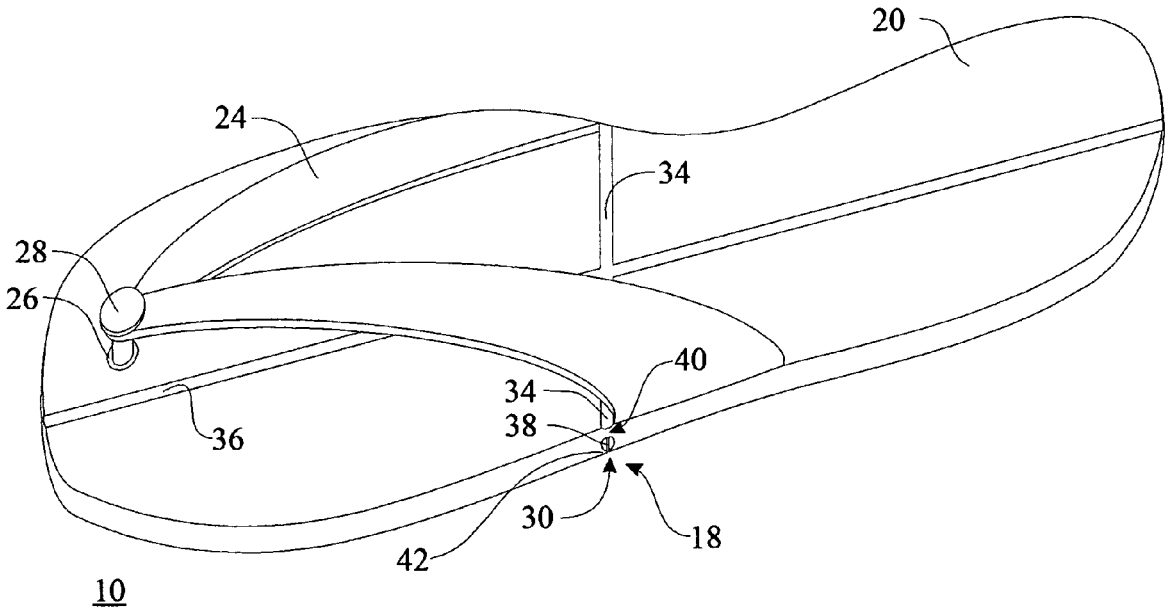
FIG. 3 presents an isometric view of a flip flop incorporating the present invention.

FIG. 3 illustrates an isometric view of said foldable flip flop 10, presented for additional clarity of the present invention. One alternate embodiment of said flip flop upper strap member 24 is illustrated wherein said flip flop upper strap member 24 comprising a pair of straps, wherein each side is secured to said flip flop sole with molded hinge 12 (as understood by FIGS. 1 and 2) and secured at a toe section via a upper front securing member 28 that is coupled to said flip flop sole with molded hinge 12 via said upper front securing aperture 26. The illustration presents said molded hinge section 18 respective to said transverse hinge top recess 34, incorporated transverse to said flip flop sole with molded hinge 12. It is understood that a similar said molded hinge section 18 could optionally be incorporated respective to an optional said longitudinal hinge top recess 36, incorporated longitudinal to said flip flop sole with molded hinge 12.

Figure 4:
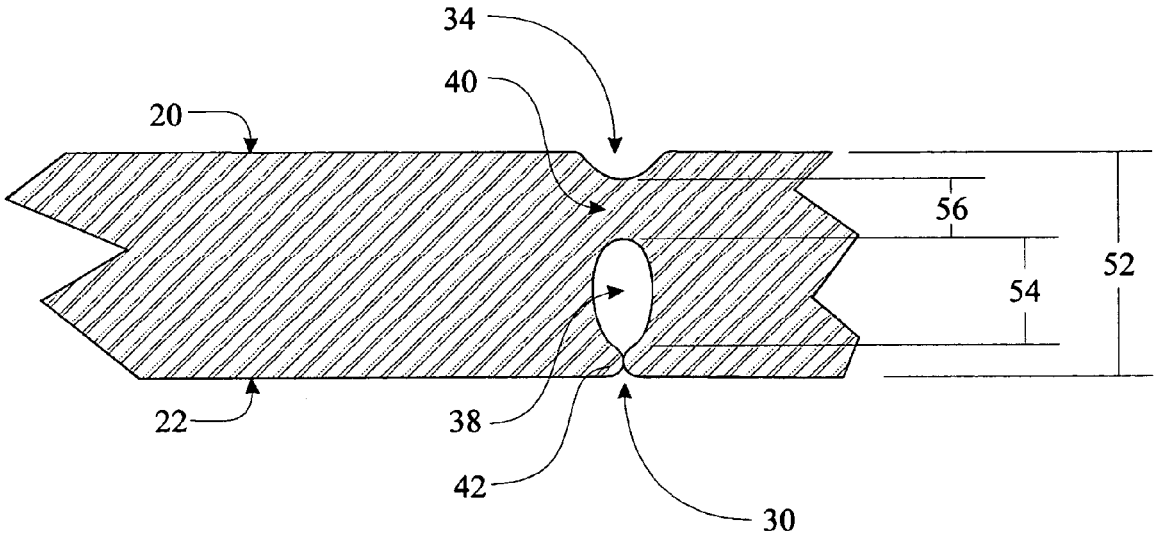
FIG. 4 presents a detailed cross sectional view of the molded hinge section respective to the present invention.

FIG. 4 illustrates said molded hinge section 18, further presenting dimensional properties in conjunction with a preferred embodiment of the present invention. Said flip flop sole with molded hinge 12 would have a thickness of sole thickness at hinge 52 at the region proximate said molded hinge section 18. Said flexible hinge aperture 38 would be of a diameter respective to hinge aperture height 54, wherein said hinge aperture height 54 is optimally ⅓ of said sole thickness at hinge 52. Said hinge aperture height 54 can be anywhere between 1/10 of said sole thickness at hinge 52 and ¾ of said sole thickness at hinge 52. Said molded flexible hinge section 40 would have a cross sectional thickness designated by molded flexible hinge section thickness 56, wherein said molded flexible hinge section thickness 56 is optimally ⅓ of said sole thickness at hinge 52. Said molded flexible hinge section thickness 56 can be anywhere between % of said sole thickness at hinge 52 and 9/10 of said sole thickness at hinge 52. Said transverse hinge top recess 34 would have a depth of approximately 1/10 of said sole thickness at hinge 52. Said hinge limitation contact section 42 would have a thickness of the balance of material, approximately ⅓ of said sole thickness at hinge 52.

Various changes may be made to the embodiments shown herein without departing from the scope of the present invention which is limited only by the following claims.

What is claimed:

1. A foldable sandal, said foldable sandal comprising:

a molded sole having a central sole thickness defined as a dimension between a foot contacting surface of the sole and a ground contact surface of the sole proximate a transverse center line of the sole provided having a transverse orientation of the sole;

an upper strap member for securing one's foot to said foldable footwear, the upper strap member being in a form factor of a sandal having each end of said strap secured at each of a instep and an outstep side of the shoe and designed to be placed over a front portion of a wearer's foot; and a hinge molded into the molded sole, said hinge comprising:

a flexible hinge aperture extending laterally across the midsection of the sole, extending upward from the ground contact surface of the sole into the sole a distance that is greater than ¼ and less than 9/10 of the central sole thickness, and a hinge top recess provided parallel to said flexible hinge, located along the foot contact surface, wherein said flexible hinge is provided allowing the user to fold the molded sole such to have a heel section of the foot contact surface become substantially parallel to and opposing a toe section of the foot contact surface.

2. A foldable sandal as recited in claim 1, wherein the upper strap member further includes a front securing member used to couple the upper strap member via a third attachment point, attaching an intermediate location of the upper strap member to a forward toe section of the molded sole.

3. A foldable sandal as recited in claim 2, wherein at least one end of the upper strap member is secured to said sole at a location between the flexible hinge and the heel section.

4. A foldable sandal as recited in claim 1, the sole further comprising a hinge top recess provided parallel to said flexible hinge, located along the foot contact surface.

5. A foldable sandal as recited in claim 4, wherein the hinge top recess has a depth that is up to 1/10 of the central sole thickness.

6. A foldable sandal as recited in claim 1, wherein the flexible hinge aperture has a depth that is at least ½ of the central sole thickness.

7. A foldable sandal as recited in claim 1, wherein the flexible hinge aperture has a depth that is at least ¾ of the central sole thickness.

8. A foldable sandal, said foldable sandal comprising:

a molded sole having a central sole thickness defined as a dimension between a foot contacting surface of the sole and a ground contact surface of the sole proximate a transverse center line of the sole provided having a transverse orientation of the sole;

an upper strap member for securing one's foot to said foldable footwear, the upper strap member being in a form factor of a sandal having each end of said strap secured at each of a instep and an outstep side of the shoe and designed to be placed over a front portion of a wearer's foot; and a hinge molded into the molded sole, said hinge comprising:

a flexible hinge aperture extending laterally across the mid-section of the sole, extending upward from the ground contact surface of the sole into the sole a distance that is greater than ¼ and less than 9/10 of the central sole thickness;

a hinge limitation contact section located along the ground contact end of the flexible hinge aperture, wherein said hinge limitation contact section limits a heel section of said sole from rotating downward substantially below a planar configuration, and a hinge top recess provided parallel to said flexible hinge, located along the foot contact surface, wherein said flexible hinge is provided allowing the user to fold the molded sole such to have a heel section of the foot contact surface become substantially parallel to and opposing a toe section of the foot contact surface.

9. A foldable sandal as recited in claim 8, wherein the upper strap member further includes a front securing member used to couple the upper strap member via a third attachment point, attaching an intermediate location of the upper strap member to a forward toe section of the molded sole.

10. A foldable sandal as recited in claim 9, wherein at least one end of the upper strap member is secured to said sole at a location between the flexible hinge and the heel section.

11. A foldable sandal as recited in claim 8, the sole further comprising a hinge top recess provided parallel to said flexible hinge, located along the foot contact surface.

12. A foldable sandal as recited in claim 11, wherein the hinge top recess has a depth that is up to 1/10 of the central sole thickness.

13. A foldable sandal as recited in claim 8, wherein the flexible hinge aperture has a depth that is at least ½ of the central sole thickness.

14. A foldable sandal as recited in claim 8, wherein the flexible hinge aperture has a depth that is at least ¾ of the central sole thickness.

* * * * *